US008373054B2

(12) United States Patent
Hara et al.

(10) Patent No.: US 8,373,054 B2
(45) Date of Patent: Feb. 12, 2013

(54) ELECTRONIC MUSICAL INSTRUMENT

(75) Inventors: Akihide Hara, Hamamatsu (JP); Yasuhiro Kawano, Iwata (JP)

(73) Assignee: Yamaha Corporation (JP)

( * ) Notice: Subject to any disclaimer, the term of this patent is extended or adjusted under 35 U.S.C. 154(b) by 27 days.

(21) Appl. No.: 13/180,656

(22) Filed: Jul. 12, 2011

(65) Prior Publication Data

US 2012/0011988 A1 Jan. 19, 2012

(30) Foreign Application Priority Data

Jul. 13, 2010 (JP) ..... 2010-158989

(51) Int. Cl.
*G10H 1/38* (2006.01)

(52) U.S. Cl. ..... 84/613; 84/609; 84/610; 84/615; 84/637; 84/649; 84/650; 84/653; 84/669

(58) Field of Classification Search ..... None
See application file for complete search history.

(56) References Cited

U.S. PATENT DOCUMENTS

| | | | | |
|---|---|---|---|---|
| 5,641,928 | A | 6/1997 | Tohgi et al. | |
| 5,747,716 | A * | 5/1998 | Matsumoto | 84/609 |
| 7,288,711 | B2 * | 10/2007 | Hasegawa | 84/613 |
| 7,432,437 | B2 * | 10/2008 | Ito et al. | 84/638 |
| 7,994,411 | B2 * | 8/2011 | Osada | 84/609 |
| 2001/0007221 | A1 | 7/2001 | Uehara | |
| 2003/0051595 | A1 * | 3/2003 | Hasegawa | 84/637 |
| 2008/0072745 | A1 * | 3/2008 | Ito et al. | 84/638 |
| 2009/0031884 | A1 | 2/2009 | Arai et al. | |
| 2010/0126332 | A1 * | 5/2010 | Kobayashi | 84/613 |
| 2010/0170382 | A1 * | 7/2010 | Kobayashi | 84/613 |
| 2011/0226117 | A1 * | 9/2011 | Osada | 84/609 |
| 2012/0011988 | A1 * | 1/2012 | Hara et al. | 84/613 |
| 2012/0125179 | A1 * | 5/2012 | Kobayashi | 84/611 |

FOREIGN PATENT DOCUMENTS

| | | | |
|---|---|---|---|
| CN | 101276581 | A | 10/2008 |
| EP | 1 947 639 | A1 | 7/2008 |
| EP | 1 975 920 | A2 | 10/2008 |
| JP | 2768233 | B2 | 4/1998 |
| WO | 98/58364 | A1 | 12/1998 |

OTHER PUBLICATIONS

Extended European Search Report for corresponding EP 11173548.6, dated Oct. 11, 2011.

Office Action issued in corresponding Chinese Patent Application 201110196529.1 dated Jun. 5, 2012. English Translation provided.

* cited by examiner

*Primary Examiner* — Marlon Fletcher

(74) *Attorney, Agent, or Firm* — Ross, Kimms & McDowell LLP

(57) ABSTRACT

When musical performance data is input to the electronic musical instrument in accordance with user's operation for musical performance, the electronic musical instrument detects a chord in accordance with the input musical performance data at the defined timing T3 at which the chord detection timing ends. On the electronic musical instrument, furthermore, the application of the detected chord to the musical performance is instructed by user's pedal (foot switch) operation of turning off the pedal. In a case where the instruction to apply the chord has been already accepted at the chord detection timing T3 or in a case where the instruction to apply the chord has been accepted by user's pedal-off operation at a point in time (Tpf) situated between the chord detection timing T3 and the time limit T4, the detected chord is to be applied to the musical performance.

13 Claims, 6 Drawing Sheets

FIG.2B chord condition setting screen meter : 4/4 tempo : ♩=78 chord detection reference position :

(•) first beat ( ) second beat (•) third beat ( ) fourth beat from chord detection timing start position to reference position 250 ms from chord detection reference position to timing end position 50 ms from chord detection timing end position to time limit position 60 ms

OK CANCEL

ELECTRONIC MUSICAL INSTRUMENT

BACKGROUND OF THE INVENTION

1. Field of the Invention

The present invention relates to an electronic musical instrument which allows a user to normally play a musical piece with the user's both hands, and applies user's expected chords to the musical piece.

2. Description of the Related Art

Conventionally, there are electronic musical instruments having a chord detection function which detects chords on the basis of musical performance data generated in accordance with user's musical performance on a keyboard. For example, an electronic musical instrument disclosed in Japanese Patent Publication No. 2768233 detects a chord at each beat timing determined in accordance with a predetermined note length of automatic accompaniment and at each timing which is near the beat timing but is away from the beat timing by a certain amount of time without reference to time at which musical performance data is input.

Although the conventional chord detection art allows chord detection during player's piano performance (with both hands), the chord detection is done on the basis of player's piano performance at certain beat timings. Assume that the player plays the arpeggio with the payer's left hand and melody with the player's right hand in a case of detection timing of every two beats in four-four time. Even if the player desires to maintain a chord detected at the first beat (at the top of a bar) until the end of the bar, the conventional chord detection art detects and applies a chord on the basis of keys played at the third beat. That is, the chord applied at the third beat may not be the one that the player desires.

SUMMARY OF THE INVENTION

The present invention was accomplished to solve the above-described problem, and an object thereof is to provide an electronic musical instrument which allows a user to play the electronic musical instrument with the user's both hands, and also applies chords detected at user's intended timings to user's musical performance.

It is a major feature of the present invention to provide an electronic musical instrument including a musical performance data input portion (5; P11 to P12, N4) for inputting musical performance data (Note List) in accordance with user's operation for musical performance; a chord detection timing setting portion (7; P3) for setting a chord detection timing (T1 to T3); a chord detection portion (P13=YES→P14) for detecting a chord (Chord) at a point in time (T3) when the chord detection timing (T1 to T3) ends on the basis of the musical performance data (Note List) input by the musical performance data input portion (P12); a chord application instruction portion (6) for instructing to apply the chord (Chord) detected by the chord detection portion (P14); a time limit setting portion (7; P3) for setting a time limit (T4) during which the instruction to apply the detected chord (Chord) is allowed; and a chord application portion (C6 to C7) for applying the chord (Chord) detected by the chord detection portion (P14) to the musical performance in a case (P13=YES→C5=YES) where the application of the detected chord has been instructed by the chord application instruction portion (6) at the point in time (T3) when the chord detection timing (T1 to T3) ends or in a case (P16=YES→C5=YES) where the application of the detected chord (Chord) has been instructed by the chord application instruction portion (6) at a point in time which is situated between the point (T3) at which the chord detection timing (T1 to T3) ends and the time limit (T4). Parenthesized numbers and terms, which are reference numbers and terms used in an embodiment described below, are provided for convenience of understanding. Hereafter, parenthesized reference numbers and terms will be provided for the convenience of understanding.

The electronic musical instrument according to the present invention can further include an applied chord storage portion (2; C7) for storing the chord (Chord List) applied by the chord application portion (C6 to C7), wherein the chord detection portion (P14) detects a chord on the basis of the chord (Chord List) stored in the applied chord storage portion (2) and the musical performance data (Note List) input by the musical performance data input portion (P12, N4).

The electronic musical instrument having the major feature of the present invention is designed such that a timing in which a chord is detected, that is, chord detection timing T1 to T3 is defined (7; P3) with respect to periodic musical timing provided at every few bars or at every few beats, for example. When musical performance data (Note List) corresponding to user's operation for musical performance is input to the electronic musical instrument (5; P11 to P12), the electronic musical instrument detects a chord in accordance with the input musical performance data (Note List) at the end position (T3) of the defined timing (T1 to T3) (P13=YES→P14). On the electronic musical instrument, furthermore, the application of the detected chord to the musical performance is instructed by use of an operating element (6) such as a pedal (foot switch) as an instruction portion. More specifically, the application of the detected chord is instructed by user's operation of turning off the pedal. On the electronic musical instrument, in addition, time limit (T4) during which the instruction to apply the chord is allowed even after the end position (T3) of the chord detection timing (T1 to T3) is previously defined (7; P3). In a case where the instruction to apply a chord by the chord application instruction portion (6) has been already accepted at the end position (T3) of the chord detection timing (T1 to T3) at which the chord is detected (P13=YES→C5=YES) or in a case where the instruction to apply a chord by the chord application instruction portion (6) has been accepted at a point in time situated between the end position (t3) of the chord detection timing (T1 to T3) at which the chord is detected and the time limit (T4) (P16=YES→C5=YES), the detected chord is to be applied to the musical performance (C6 to C7).

According to the present invention, more specifically, if the pedal (foot switch) is in the on-state (C5=NO) at a moment when a chord is detected in accordance with musical performance data (Note List) at the end position (T3) of the chord detection timing (T1 to T3) corresponding to the bar or beat timing (P13=YES→P14), the detected chord will not be applied to musical performance. If the pedal is in the off-state at that moment, the detected chord is applied to the musical performance (C5=YES→C6→C7). In a case where the pedal is turned off within a certain amount of time (by time limit T4) after the chord detection timing end position (T3) even if the pedal is in the on-state at the chord detection timing end position (T3) (P16=YES→C5=YES), the detected chord is immediately applied to the musical performance (C6 to C7).

Therefore, the electronic musical instrument according to the present invention allows a user to normally play the electronic musical instrument with the user's both hands, and also applies chords detected at user's intended timings to the user's musical performance. According to the present invention, furthermore, because it is determined by the user's pedal (foot switch) operation whether a detected chord is to be applied (C5=YES), the electronic musical instrument allows the application of detected chords in a style which matches the actual performance style on a piano, also allowing the user to instruct the application of chord by the operation integrated into musical performance. Furthermore, the electronic musical instrument according to the present invention not only switches between "chord-detection performed and not performed" by use of the operating element which is turned on and off such as a pedal (foot switch) but also detects a chord without fail in accordance with musical performance data (Note List) at the defined timing (T3) (P13=YES→P14) to determine whether the detected chord should be applied on the basis of the state of the pedal at the chord detection (P14→C5) or on the basis of the timing at which the pedal is turned from on to off (P16=YES→C4→C5). Therefore, the electronic musical instrument is able to accommodate the time lag produced when the user releases the pedal.

The electronic musical instrument according to the present invention is designed such that the applied chord (Chord List) is stored in the chord storage portion (2; C7), so that the electronic musical instrument detects a chord in accordance with the input musical performance data (Note List) and the chord (Chord List) stored in the applied chord storage portion (P14). Therefore, the electronic musical instrument according to the present invention is able to detect a chord in consideration of an immediately preceding chord or the progression of preceding chords.

BRIEF DESCRIPTION OF THE DRAWINGS

FIG. 2B is an example of chord condition setting screen according to the embodiment of the present invention;

DESCRIPTION OF THE PREFERRED EMBODIMENT

[Outline of System Configuration]

Figure 1:
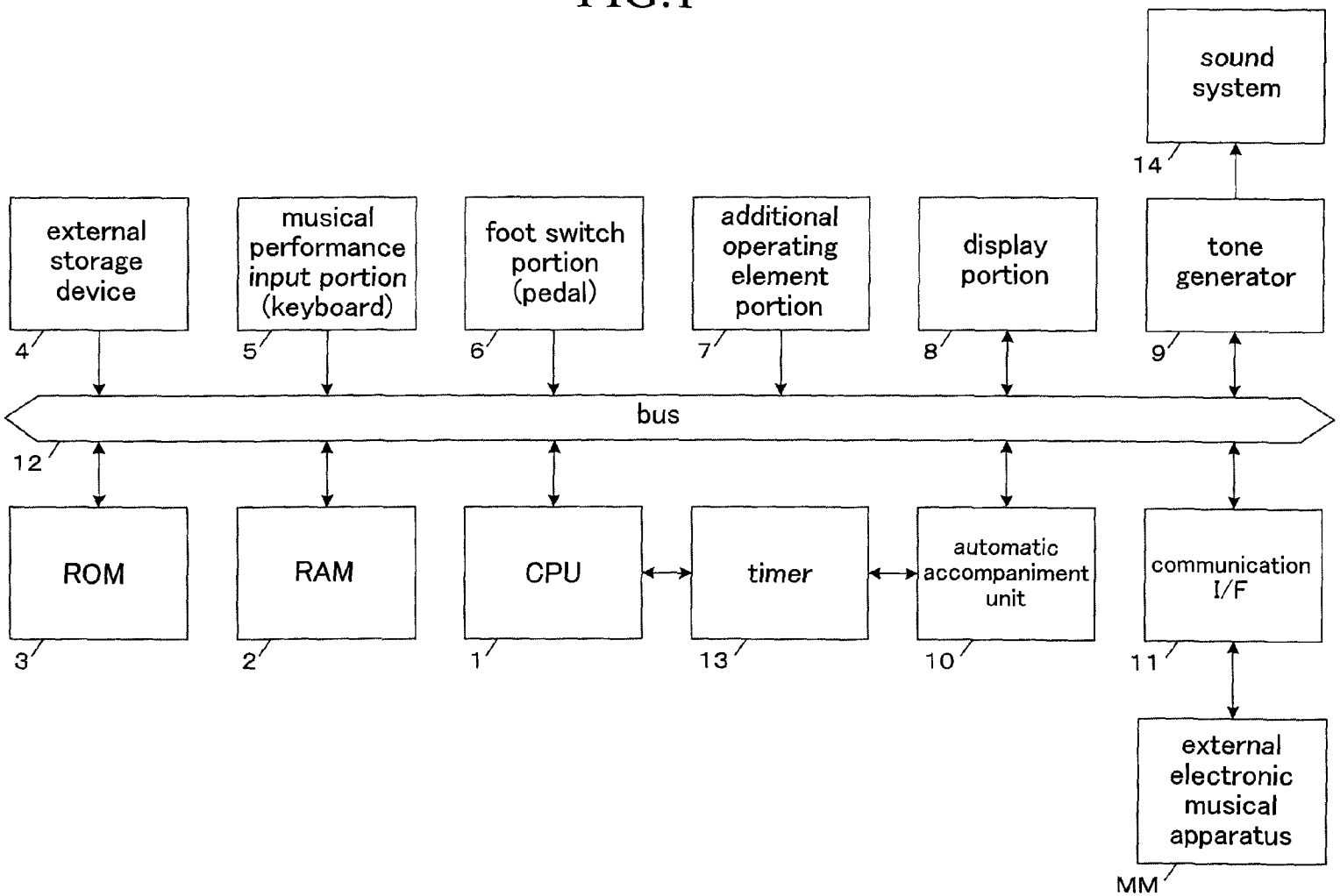
FIG. 1 is an example hardware configuration of an electronic musical instrument according to an embodiment of the present invention.

FIG. 1 is an example hardware configuration of an electronic musical instrument according to an embodiment of the present invention. The electronic musical instrument according to the embodiment of the present invention is a kind of computer having a capability of electronically processing musical information. As indicated in FIG. 1, the electronic musical instrument has a central processing unit (CPU) 1, a random access memory (RAM) 2, a read-only memory (ROM) 3, an external storage device 4, a musical performance input portion (keyboard) 5, a foot switch (pedal) portion 6, an additional operating element portion 7, a display portion 8 a tone generator 9, an automatic accompaniment unit 10, a communication interface (I/F) 11 and the like. These components 1 to 11 are connected each other via a bus 12.

The CPU 1 serves as a part of a data processing portion along with the RAM 2 and the ROM 3 to carry out various kinds of musical information processing in accordance with certain control programs including an automatic accompaniment added musical performance processing program through the use of a clock served by a timer 13. The RAM 2 is used as a working area for temporarily storing various kinds of data necessary for the processing. When the electronic musical instrument is in an automatic accompaniment added musical performance mode in which the automatic accompaniment added musical performance process is carried out, for example, the timer 13 measures various kinds of time set for chord detection and application under the control of the CPU 1, and generates tempo clocks in accordance with a set tempo. In the RAM 2, in addition, various registers necessary for the chord detection and application are provided. In the ROM 3, furthermore, various control programs and various kinds of control data necessary for the processing are previously stored.

The external storage device 4 includes storage media such as HD (hard disk), FD (flexible disk), CD (compact disk), DVD (digital versatile disk) and semiconductor memory such as flash memory, and their drives. Desired information such as the control programs and various kinds of musical piece data can be stored in the desired storage media. In addition, these storage media may be detachable or be integrated into the electronic musical instrument. The detachable storage media include USB memory.

The musical performance input portion 5 is formed of a musical performance operating element such as a keyboard and a musical performance operation detection circuit which detects operation of the musical performance operating element and delivers musical performance operation information corresponding to the detected results to the data processing portion (the CPU1, RAM 2 and ROM 3). The foot switch portion 6, which is also referred to as a pedal portion, is formed of a pedal operating element operated by a user's foot and a pedal operation detection circuit which detects switching operation (on/off) of the pedal operating element and delivers foot switch operation information corresponding to the detected results to the data processing portion (in some occasions, the reference number "6" indicates the pedal operating element itself). In the automatic accompaniment added musical performance mode, the foot switch portion 6 serves as "a chord application instruction portion". The additional operating element portion 7 is formed of additional operating elements (setting elements) such as key switches and a setting operation detection circuit which detects operation of these operating elements and delivers operation information corresponding to the detected results to the data processing portion. The data processing portion (the CPU 1, RAM 2 and ROM 3) controls respective parts of the electronic musical instrument in accordance with these kinds of operation information to transmit musical performance information corresponding to the musical performance operations input by the musical performance input portion 5 to the tone generator 9 or to make the electronic musical instrument enter the automatic accompaniment added musical performance mode by the operation of a mode setting button included in the additional operating element portion 7, for example.

The display portion 8 has a display such as an LCD for displaying various kinds of information necessary for musical performance and for making settings. The display portion 8 also has integrated lamps provided for switches included in the musical performance input portion 5, the foot switch portion 6 and the additional operating element portion 7. The display portion 8 controls the display and illumination under the direction of the data processing portion to assist user's musical performance and setting operation.

The tone generator 9, which has a tone generating portion and a DSP, generates musical tone signals in accordance with musical performance information obtained on the basis of the musical performance operation information delivered from the musical performance input portion 5 or in accordance with musical piece data read out from the storage device 4. The tone generator 9 also adds certain effects to the generated musical tone signals. A sound system 14 connected to the tone generator 9 has a D/A converting portion, amplifiers and speakers, and emits musical tones corresponding to the musical tone signals output from the tone generator 9. In the automatic accompaniment added musical performance mode, the automatic accompaniment unit 10 is given a tempo for automatic accompaniment on the basis of the tempo clocks provided by the timer 13 and generates, in accordance with the tempo clocks, automatic accompaniment tones on the basis of accompaniment style data corresponding to chords provided by the data processing portion (the CPU 1, RAM 2 and ROM 3).

The communication I/F 11, which includes a wired musical I/F such as MIDI, a general-purpose network I/F such as USB and a general-purpose short distance wireless I/F such as wireless LAN, allows the electronic musical instrument to communicate with an external electronic musical apparatus MM. Through the use of the communication I/F, for example, the electronic musical instrument can retrieve MIDI formatted musical piece data from the external electronic musical apparatus MM to store the retrieved musical piece data in the storage device 4.

[Overview of Detection and Application of Chord]

Figure 2A:
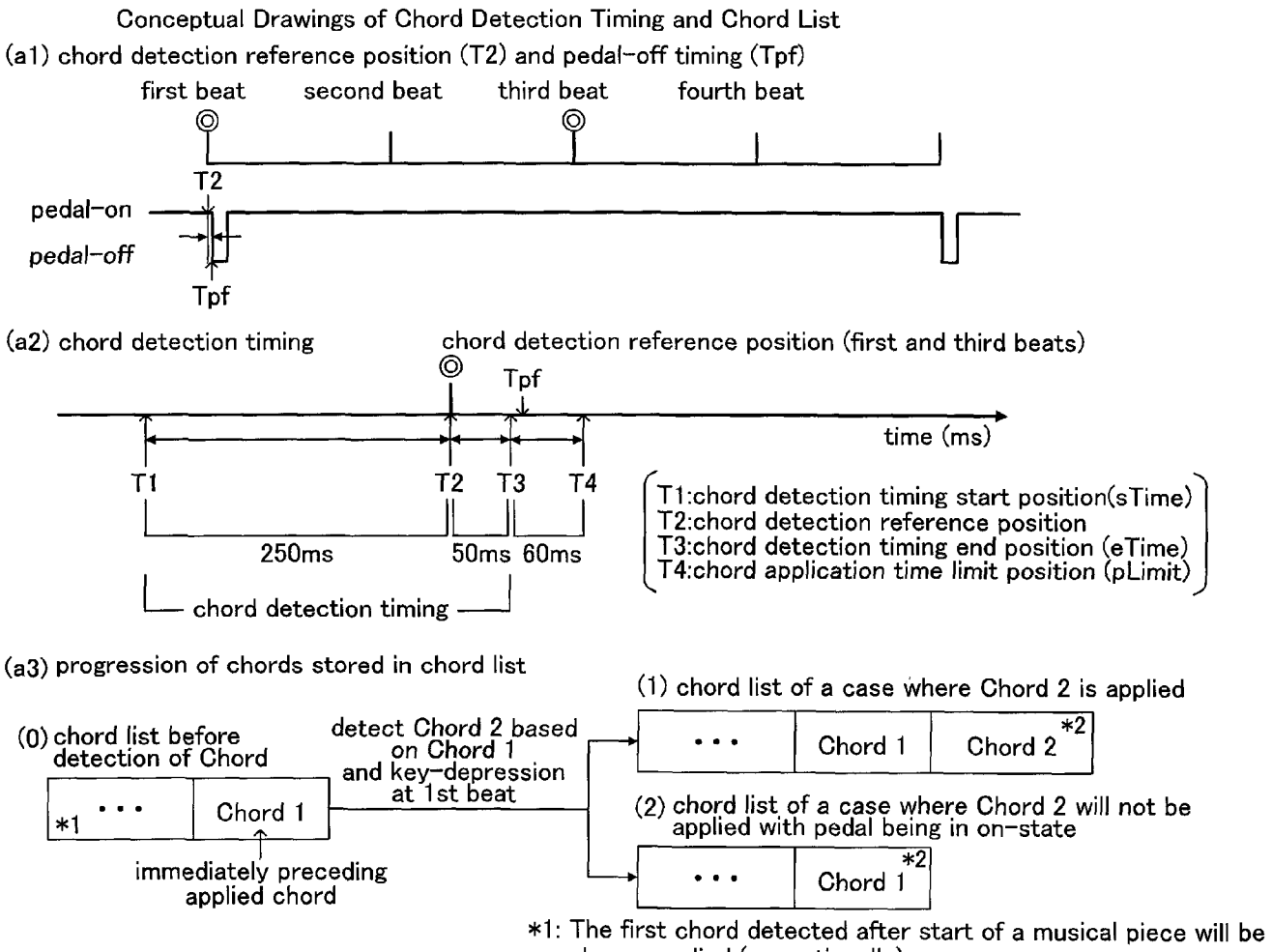
FIG. 2A is an example of chord detection timing and chord application time limit according to the embodiment of the present invention.

As for the electronic musical instrument according to the embodiment of the present invention, the automatic accompaniment added musical performance process detects a chord at a certain bar or a certain beat timing on the basis of musical performance data input by the musical performance input portion 5 regardless of whether the pedal operating element (foot switch portion) 6 is in the on-state or off-state. In a case where a chord is detected when the pedal operating element 6 is in the off-state, the detected chord is to be automatically applied to automatic accompaniment. Even in a case where a chord is detected when the pedal operating element 6 is in the on-state, if the pedal operating element 6 is turned off within a certain time limit, the detected chord can be immediately applied to automatic accompaniment at that point in time when the pedal operating element 6 is turned off. In other words, the pedal operating element 6 of the electronic musical instrument serves as a chord application instruction portion. In a case of an electronic musical instrument having only a keyboard as musical performance operating elements, therefore, the pedal operating element 6 is to be connected to the electronic musical instrument. From the pedal operating element 6, an ON signal or an OFF signal is transmitted to the data control portion (the CPU 1, RAM 2 and RAM 3) by a depression or a release of the pedal operating element 6, respectively, so that a value "0" or "1" corresponding to the respective signals is stored in a "pedal-off" register provided in the RAM 2. FIG. 2A and FIG. 2B indicate timing of chord detection and example settings of chord application time limit according to the embodiment of the present invention. In FIG. 2A, timing of chord detection and an example image of a chord list are indicated.

In (a1) of FIG. 2A, an example chord detection reference position and a typical example of pedal operation made at the chord detection reference position are indicated. The horizontal axis indicates a time axis along which time progresses toward the right. The Chord detection reference position T2 indicated by ◎, which indicates a certain bar or a beat timing defined regarding the musical performance data by user's operation, serves for the user as a timing at which the instruction to detect a chord or to detect to apply a chord is expected. In this example, as indicated in the upper part of (a1), in the musical performance data of a bar having four beats, the first and third beats are defined as the chord detection reference position T2. In a case where the user is to turn off the pedal 6 at the first beat in this setting, the pedal 6 actually switches from on to off as indicated in the lower part of (a1). More specifically, the pedal 6 is actually turned off at pedal-off timing Tpf which is later than the chord detection reference position T2 with a certain delay. An experiment has found that in a case where a user releases the pedal 6 (off) at a timing (T2) where the user desires to detect and apply a chord, and then immediately depresses the pedal 6 (on) again while playing the keyboard with the user's both hands, the switching off of the pedal 6 (off-timing Tpf) tends to be later than the expected beat position (beat timing) to be delayed approximately by a 32nd note to 64th note (by approximately 96 ms to 48 ms) if the tempo is set at "78" (beats/minute). In consideration of such an actual tendency of delayed pedal operation, time limit position T4 during which the instruction to apply a chord is effective can be provided as indicated in (a2).

In (a2), an example of chord detection timing and chord application time limit position is indicated. The scale of the time axis (horizontal axis) along which the time progresses toward the right-pointing arrow is scaled up compared to that of (a1). The chord detection timing starts at chord detection timing start position T1 which is earlier than the chord detection reference position T2 by a certain amount of time, and finishes at chord detection timing end position T3 which is later than the chord detection reference position T2 by a certain amount of time. As described above, the timings T1 to T3 between which chord detection is done have time ranges T1 to T2, T2 to T3 before and after the certain beat position T2 which serves as a reference, so that the musical performance data (note events) input during the times T1 to T3 is used for the chord detection at the time T3. More specifically, the chord detection is done on the basis of the musical performance data emitted during the chord detection timing (time ranges) T1 to T3 by examining, for example, the tone pitch of target musical performance data (note events) to compare with constituent notes of respective chords to detect a matched or the closest chord. In addition, the chord detection may be done in consideration of the immediately preceding chord or the progression of preceding chords. Furthermore, it is preferable that musical performance data which is considered ornament and musical performance data which is considered missed touch are excluded from the target musical performance data to detect a chord. In this example, a new chord is to be detected (in a normal manner) on the basis of musical performance data emitted (input) during the chord detection timing in consideration of the progression from the immediately preceding applied chord. At the first chord detection timing after the start of a musical performance, however, the chord detection is carried out on the basis only of the musical performance data input during the first chord detection timing T2 to T3 with the chord detection reference position T2 of the first beat of the first bar being defined as the start position T1.

The chord application time limit position T4 is the latest time position of the off-timing Tpf of the pedal 6, indicating the position until which the application of the chord detected at time T3 is allowed. As indicated in the figure, if the pedal is turned off at the timing Tpf situated between the times T3 and T4, a chord detected at the timing T3 is applied to automatic accompaniment at the timing Tpf where the pedal is turned off. As indicated in (a3), as a result, the detected chord is added to the chord list. In this example, respective values of the time ranges are as follows: T1 to T2=250 ms, T2 to T3=50 ms, T3 to T4=60 ms [ms: millisecond].

In a case where the pedal 6 has been already turned off at the timing T3, a chord is detected at the timing T3 to be concurrently applied to automatic accompaniment. During the automatic accompaniment added musical performance processing, the chord detection timing start position T1, the chord detection timing end position T3, the time limit position T4, the musical performance data (note events), the chord list, and the detected chords are stored in registers sTime, eTime, pLimit, Note List, Chord List, Chord, respectively, provided in the RAM 2 (these register names are also used to indicate content of stored information).

In (a3), example progression of the chords stored in the chord list is indicated. More specifically, (0) indicates the content of the chord list at a chord detection timing (corresponding to the chord reference position T2 of the first beat) during the automatic accompaniment added musical performance processing. In the chord list, chords detected and applied sequentially from the beginning of a musical piece are listed. At the position where the chord applied first is recorded, a chord detected on the basis of the musical performance data emitted at the first chord detection timing after the start of the musical piece is stored (*1). In other words, the chord detected first is always to be applied exceptionally. At the position where a chord applied most recently is recorded, a chord applied most recently ("chord 1" in this example) is recorded so that the chord will be referred to at the following chord detection. When the chord detection timing finishes at the chord detection timing end position T3, a chord ("chord 2" in this example) is detected on the basis of the latest data (=chord 1) of the chord list and the key-depression of the first beat indicated by the musical performance data register (Note List).

In a case where the pedal 6 has been already turned off at the time T3 at which the chord is detected (pedal-OFF="1"), or in a case where the pedal 6 is turned off at the time Tpf which follows the time T3 and precedes the time limit (pLimit) T4, the detected chord (Chord) (=chord 2) is immediately applied to be added to the chord list (Chord List) at the time T3 or at the time Tpf as indicated in (1). In a case where the pedal 6 is in the on-state at the time T3 without being turned off after the time T3 and before the time limit (pLimit) T4 (pedal-OFF="0"), the chord list (Chord List) will not be updated to keep the same content as that of (0) as indicated in (2). In the case of (1), as a result, the latest data (=chord 2) of the chord list is to be referred to for the following chord detection at the third beat. In the case of (2), the latest data (=chord 1) of the chord list is to be referred to for the following chord detection at the third beat (*2).

FIG. 2B indicates an example of chord condition setting screen displayed on the display portion 8 in the automatic accompaniment added musical performance mode. The user makes necessary settings by manipulating the operating element portion 7 in accordance with the guidance of the chord condition setting screen to fill in input/display fields and check fields corresponding to respective setting items such as meter and tempo to operate an "OK" button. By the operation of a "cancel" button, the settings are canceled so that the settings which had been made before the screen was displayed will become effective. In the shown example, if the user inputs the user's desired values in the input/display fields for meter and tempo, respectively, the input/display fields for meter and tempo display "4/4" and "α=78" ("α" is a metronome mark of a quarter note), respectively, with a chord detection reference position setting area displaying "first beat", "second beat", "third beat", etc. corresponding to the set meter and their respective check fields. In other words, selectable chord detection reference positions vary depending on meter. In the shown example, in addition, the user clicks on the respective check fields of the first and third beats, and inputs respective values in the input/display fields corresponding to "from chord detection timing start position to reference position", "from chord detection reference position to timing end position" and "from chord detection timing end position to time limit position". By user's operation of the OK button, the chord detection reference position is set at the "first beat" and the "third beat", the time range T1 to T2 is set at "250" ms, the time range T2 to T3 is set at "50" ms, and the time range T3 to T4 is set at "60" ms.

The chord detection reference position may not be set at a beat position as in the case of this example, but may be a bar position (e.g., every two bars) depending on tempo or meter. Although this example is designed such that the time ranges T1 to T2, T2 to T3 preceding and following the reference position and the time limit range T3 to T4 are set in milliseconds, these time ranges may be indicated by the length of note, the number of beats, the number of clocks, or the like.

As described above, the electronic musical instrument according to the embodiment of the present invention is designed such that the periodic musical timing such as every certain number of bars or every certain number of beats is used as the reference to provide the chord detection timing T1 to T3 indicative of the timing at which a chord is detected (7). When musical performance data (Note List) is input in accordance with user's operation for musical performance (5), a chord is detected at the set chord detection timing end position T3 on the basis of the input musical performance data (Note List). In addition, the operating element 6 such as a pedal (a foot switch) is used as a portion for instructing application of the detected chord. More specifically, the application of the chord is instructed by the user's operation of turning off the operating element 6 (pedal-off). Furthermore, the time limit T4 is previously provided during which the operation to instruct the application of the chord is accepted even after the chord detection timing end position T3. In a case where the instruction to apply the chord has been already accepted before the chord detection timing end position T3, or in a case where the instruction to apply the chord made by the user's operation of turning off the pedal is accepted at a point (Tpf) which is later than the chord detection timing end position T3 but earlier than the time limit T4, the detected chord is to be applied.

[Example Process Flows]

Figure 3:
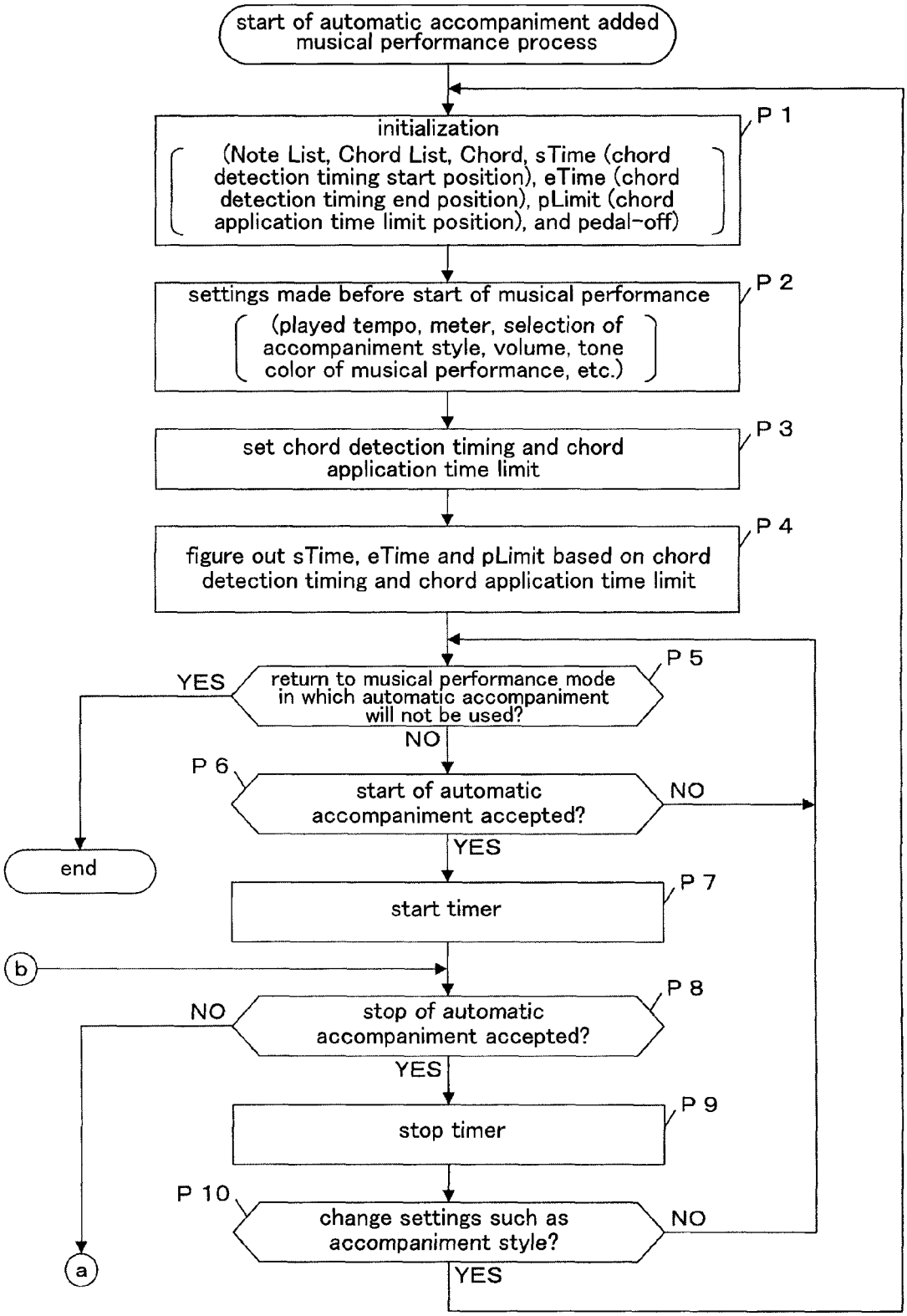
FIG. 3 is a part of an example flowchart of an automatic accompaniment added musical performance process according to the embodiment of the present invention.
Figure 4:
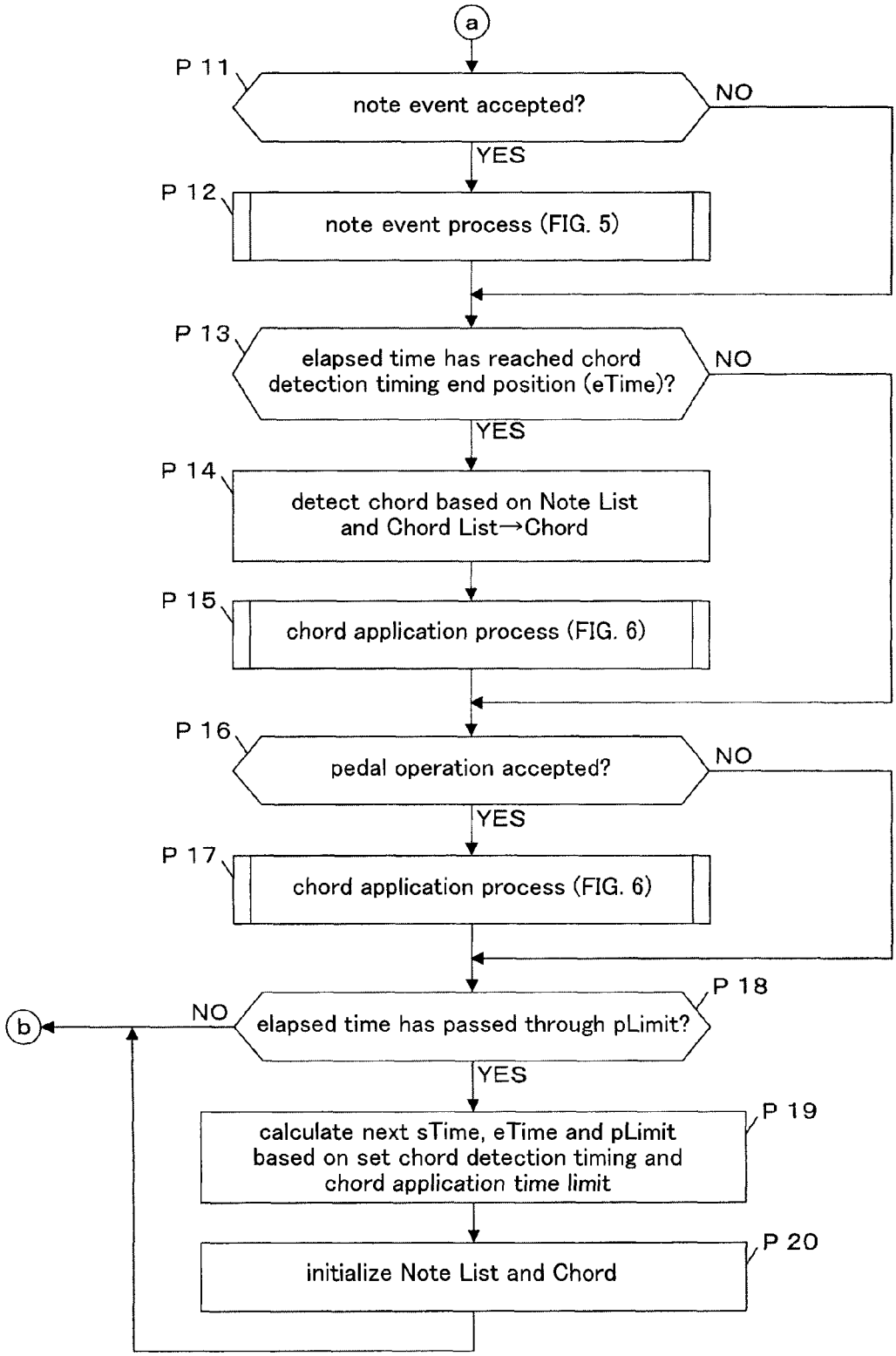
FIG. 4 is the other part of the example flowchart of the automatic accompaniment added musical performance process according to the embodiment of the present invention.

FIG. 3 and FIG. 4 are flowcharts indicative of an operating example of the automatic accompaniment added musical performance process according to the embodiment of the present invention. When the user operates an automatic accompaniment added musical performance mode button included in the operating element portion 7 during normal musical performance mode, the electronic musical instrument enters the automatic accompaniment added musical performance mode to carry out the automatic accompaniment added musical performance process indicated in FIG. 3 and FIG. 4. After the start of the automatic accompaniment added musical performance process, the CPU 1 first carries out initialization in step P1 to initialize the respective registers provided in the RAM 2 such as Note List, Chord List, Chord, slime (the chord detection timing start position), eTime (the chord detection timing end position), pLimit (the chord application time limit position) and pedal-off. In the pedal-off register, the CPU 1 records an initial value "1" indicative of a state in which the pedal is in the off-state. In the next step P2, the CPU 1 displays a musical performance condition setting screen on the display of the display portion 8 to set various musical performance conditions which are to be determined before starting a musical performance such as played tempo, meter, selection of accompaniment style, volume and tone color for musical performance in accordance with user's operation before proceeding to step P3.

In step P3, the CPU 1 displays the chord condition setting screen on the screen to set the chord detection timing T1 to T3 and the chord application time limit T4 in accordance with user's operation. In this case, the CPU 1 displays the chord condition setting screen such as the screen of FIG. 2B to allow the user to revise the played tempo and meter that have been already set in step P2. In the next step P4, the CPU 1 figures out the first chord detection timing start position (slime), chord detection timing end position (eTime) and chord application time limit (pLimit) on the basis of the chord detection timing T1 to T3 and the chord application time limit T4 set in step P3. In step P4, the CPU 1 also stores the respective positions and time limit in their corresponding registers sTime, eTime, pLimit before proceeding to step P5. In the example of FIG. 2B, sTime is set to be 250 ms earlier than the beat which serves as a reference position, while eTime is set to be 50 ms later than the beat which is the reference position, with pLimit being 60 ms later than eTime. As for the first chord detection timing start position (sTime) which is to be stored in the register sTime, however, the first chord detection reference position T2 is to be set as the chord detection timing start position.

In step P5, the CPU 1 asks the user whether the user desires to return to the normal musical performance mode in which automatic accompaniment will not be used. When it is determined that a return-to-normal musical performance mode button has been operated in order to return to the normal musical performance mode (P5=YES), the CPU 1 terminates the automatic performance added musical performance mode to return to the normal musical performance mode. When it is determined that a continuation button has been operated in order to continue the automatic accompaniment added musical performance mode (P5=NO), the CPU 1 proceeds to step P6. In step P6, the CPU 1 determines whether an instruction to start automatic accompaniment by the operation of an automatic accompaniment start button has been accepted or not. When it is determined that the instruction to start automatic accompaniment has not been made (P6=NO), the CPU 1 returns to step P5. When it is determined that the instruction to start automatic accompaniment has been accepted (P6=YES), the CPU 1 starts the timer 13 in step P7 to proceed to step P8.

In step P8, the CPU 1 determines whether an instruction to stop automatic accompaniment by the operation of an automatic accompaniment stop button has been accepted or not. When it is determined that the instruction to stop automatic accompaniment has been made (P8=YES), the CPU 1 proceeds to step P9 to stop the timer 13 to further proceed to step P10 to ask the user whether the user desires to change the settings of the musical performance conditions such as accompaniment style and the chord conditions such as the chord detection timing. When it is determined that a setting change button has been operated in order to change the settings (P10=YES), the CPU 1 returns to step P1 to make the necessary settings and calculation in steps P1 to P4 to return to step P5. When it is determined that the settings will not be changed (P10=NO), the CPU 1 immediately returns to step P5.

When it is determined in step P8 that the instruction to stop the automatic accompaniment has not been made (P8=NO), the CPU 1 proceeds to step P11 (FIG. 4) to determine whether any note events made in accordance with musical performance operation have been accepted or not. When it is determined that a note event has been accepted (P11=YES), the CPU 1 proceeds to step P12 to carry out a note event process (see FIG. 5) to proceed to step P13. When it is determined in step P11 that any note events have not been accepted (P11=NO), the CPU 1 immediately proceeds to step P13.

In step P13, the CPU 1 determines whether the elapsed time has reached the chord detection timing end position eTime or not. When it is determined that the elapsed time has reached eTime (P13=YES), the CPU 1 proceeds to step P14 to detect a chord on the basis of the information stored in Note List and Chord List by a common method to write the value of the detected chord into Chord to proceed to step P15 to carry out a chord application process (see FIG. 6) to proceed to step P16. When it is determined that the elapsed time has not reached eTime yet (P13=NO), the CPU 1 immediately proceeds to step P16.

In step P16, the CPU 1 determines whether the operation of the pedal 6 has been accepted or not. When the operation of the pedal 6 has been accepted (P16=YES), the CPU 1 reverses the content of the pedal-off register (for example, in a case of the pedal 6 having been turned on from the off-state, the CPU 1 turns the value of the pedal-off register to "0",whereas in a case of the pedal 6 having been turned off from the on-state, the CPU 1 turns the value of the pedal-off register to "1"). The CPU 1 then proceeds to step P17 to carry out the chord application process (see FIG. 6) to proceed to step P18. If any pedal operations have not been accepted (P16=NO), the CPU 1 immediately proceeds to step P18.

In step P18, the CPU 1 determines whether the elapsed time has passed through the chord application time limit position pLimit or not. In a case where the elapsed time has passed through pLimit (P18=YES), the CPU 1 proceeds to step P19 to calculate the next sTime, eTime and pLimit on the basis of the set chord detection timing and the set chord application time limit. The CPU 1 then proceeds to step P20 to initialize Note List and Chord to delete musical performance data used at the immediately preceding chord detection timing and information on the detected chord before returning to step P8 (FIG. 3). In a case where the elapsed time has not passed through pLimit (P18=NO), the CPU immediately returns to step P8.

Figure 5:
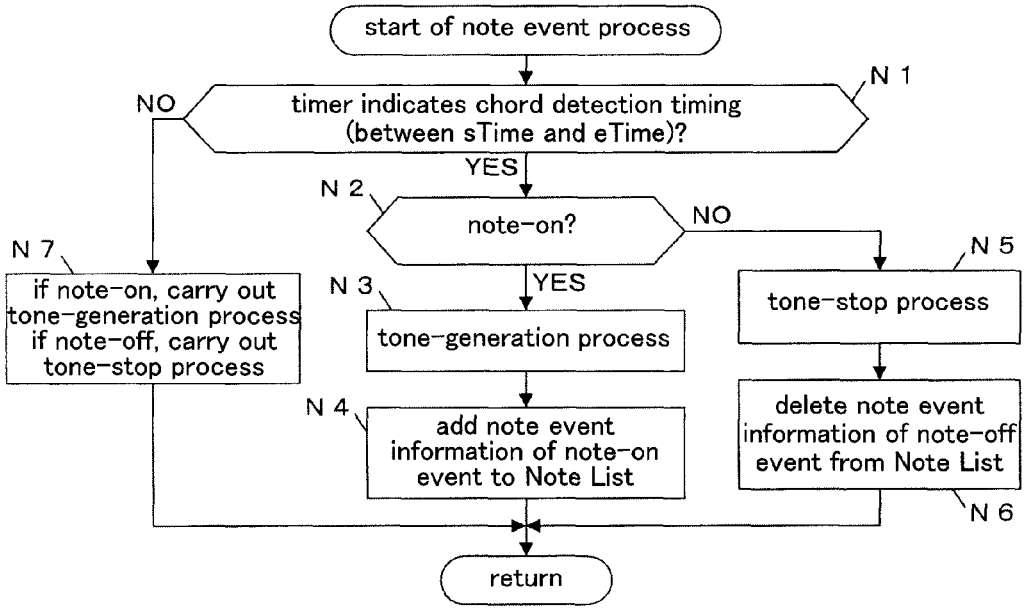
FIG. 5 is an example flowchart of a note event process according to the embodiment of the present invention.

FIG. 5 is a flowchart indicative of an operating example of the note event process carried out in step P12 (FIG. 4) of the automatic accompaniment added musical performance process. In the first step N1, the CPU 1 determines whether the timer 13 is currently indicating the chord detection timing (between sTime and eTime) or not. In a case where the timer 13 indicates a point in time falling within the range of the chord detection timing (N1=YES), the CPU 1 proceeds to step N2 to further determine whether the note event accepted in step P11 (FIG. 4) is a note-on event or not. In a case where the note event is a note-on event (N2=YES), the CPU 1 proceeds to step N3 to make the tone generator 9 carry out tone-generation processing in accordance with the note event to add note event information of the note-on event to the Note List in step N4. In a case where the note event is a note-off event (N2=NO), the CPU proceeds to step S5 to make the tone generator 9 carry out tone-stop processing in accordance with the note event to delete note event information of the note-off event from the Note List in step N6.

In a case where the timer 13 is not indicating any point in time falling within the range of the chord detection timing (between sTime and eTime) (N1=NO), the CPU 1 proceeds to step N7 to make the tone generator 9 carry out the tone-generation processing in a case where the note event accepted in step P11 (FIG. 4) is a note-on event. In a case where the note event accepted in step P11 is a note-off event, the CPU 1 makes the tone generator 9 carry out the tone-stop processing. After the steps N4, N6 and N7, the CPU 1 terminates the note event process to return to step P13 (FIG. 4) of the automatic accompaniment added musical performance process.

Figure 6:
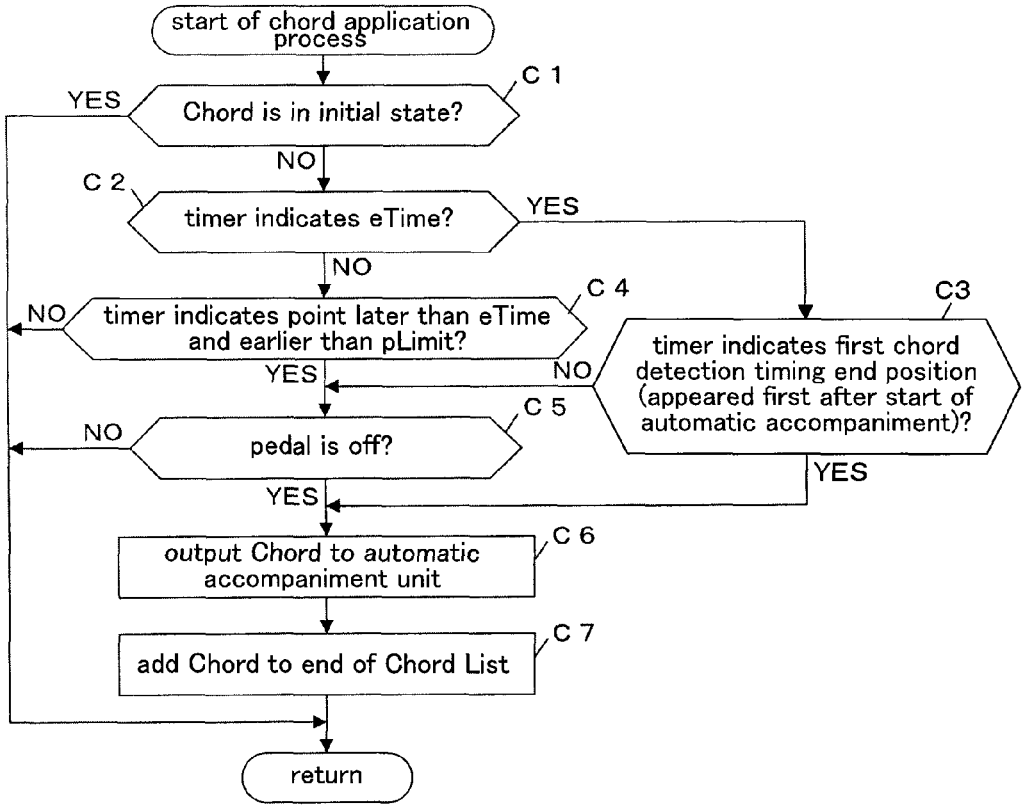
FIG. 6 is an example flowchart of a chord application process according to the embodiment of the present invention.

FIG. 6 is a flowchart indicative of an operating example of the chord application process carried out in steps P14, P17 (FIG. 4) of the automatic accompaniment added musical performance process. In the first step C1, the CPU 1 determines whether the Chord is in the initial state or not. In a case where a chord has been detected, so that the Chord is not in the initial state (C1=NO), the CPU 1 proceeds to step C2 to determine whether the timer 13 is currently indicating eTime or not. In a case where the timer 13 is indicating eTime (C2=YES), the CPU 1 proceeds to step C3 to determine whether the indicated eTime is the first chord detection timing end position (appeared first after the start of the automatic accompaniment). In a case where the timer 13 is not currently indicating eTime (C2=NO), the CPU 1 proceeds to step C4 to determine whether the timer 13 is currently indicting any point in time which is later than eTime and earlier than pLimit or not. In a case where the indicated eTime is not the first chord detection timing end position (C3=NO) or in a case where the point in time indicated by the timer 13 is situated later than eTime and earlier than pLimit (C4=YES), the CPU 1 proceeds to step C5 to examine the content of the pedal-off register to determine whether the pedal-off register indicates the value "1" which represents that the pedal 6 is in the off-state.

When the CPU 1 has determined in step C3 that the timer 13 is currently indicating the first chord detection timing end position (C3=YES) or has determined in step C5 that the pedal 6 is in the off-state (C5=YES), the CPU 1 judges that the detected chord should be applied. The CPU 1 then proceeds to step C6 to output the Chord to the automatic accompaniment unit 10 to add the Chord to the end of the Chord List in step C7. When the CPU 1 has determined in step C1 that the Chord is in the initial state (C1=YES), when the CPU 1 has determined in step C4 that the timer 13 is not currently indicating any point in time which is later than eTime and earlier than pLimit (C4=NO), when the CPU 1 has determined in step C5 that the pedal 6 is not in the off-state (C5=NO), or when the CPU 1 has completed step C7, the CPU 1 terminates the chord application process to return to step P16 or P18 (FIG. 4) of the automatic accompaniment added musical performance process.

The relationship between the pedal operation and the chord application is as follows:

(1) In a case where the elapsed time has reached sTime with the pedal being in the off-state, the chord detection and application are carried out at eTime.

(2) In a case where the pedal is in the on-state at sTime without being turned off at any point before pLimit, the chord detected at eTime is to be deleted.

(3) In a case where the pedal is in the on-state at sTime and is turned off before eTime, the chord detection and application are carried out at eTime.

(4) In a case where the pedal is in the on-state at sTime, kept on until eTime but turned off before pLimit, the chord detected at eTime is immediately applied at the point at which the pedal is turned off.

[Various Embodiments]

Although the preferred embodiment of the present invention has been described above with reference to the drawings, the embodiment is a mere example. Therefore, the present invention can be variously modified without departing from the scope and spirit of the present invention. For example, although the embodiment is designed such that the settings of the timing at which the chord detection is carried out are made on the chord condition setting screen displayed on the electronic musical instrument, the settings may be made by use of the operating elements (7) such as switches and sliders provided on the electronic musical instrument. Alternatively, a table which correlates tempo with detection timing, for example, may be provided in the electronic musical instrument so that the settings of chord detection timing will be automatically made in accordance with the tempo of a musical piece which the user plays. In addition, the settings of the timing may be made not in accordance with the musical piece which is to be played but in accordance with accompaniment style data to be used.

In the embodiment, the time limit for chord application is defined on the same setting screen as that of the chord detection timing. However, the time limit for chord application may be defined on a separately provided setting screen. Alternatively, the time limit for chord application may be defined by use of different operating elements such as switches. In accordance with tempo or accompaniment style data to be used, furthermore, a recommended value may be presented to the user.

As for the chord detection, the key of a musical piece may be designated or detected so that the detected key will be used for the chord detection. As for the application of a detected chord, in a case where the detected chord is judged to be applied, the electronic musical instrument can generate not only automatic accompaniment notes but also harmony notes on the basis of the detected chord.

In the embodiment, time is counted when the automatic accompaniment is turned on. By use of the function of synchronized start, however, the electronic musical instrument may actually start counting time when the user starts musical performance. In the embodiment, furthermore, applied chords are stored one after another in a list so that the stored chords will be used for the detection of the following chord. However, the number of stored chords may be limited so that only some latest chords will be stored.

What is claimed is:

1. An electronic musical instrument comprising:

a musical performance data input portion for inputting musical performance data in accordance with user's operation for musical performance;

a chord detection timing setting portion for setting a chord detection timing;

a chord detection portion for detecting a chord at a point in time when the chord detection timing ends on the basis of the musical performance data input by the musical performance data input portion;

a chord application instruction portion for instructing to apply the chord detected by the chord detection portion;

a time limit setting portion for setting a time limit during which the instruction to apply the detected chord is allowed; and a chord application portion for applying the chord detected by the chord detection portion in a case where the application of the detected chord has been instructed by the chord application instruction portion at the point in time when the chord detection timing ends or in a case where the application of the detected chord has been instructed by the chord application instruction portion at a point in time which is situated between the point at which the chord detection timing ends and the time limit.

2. The electronic musical instrument according to claim 1 further comprising:

an applied chord storage portion for storing the chord applied by the chord application portion, wherein the chord detection portion detects a chord on the basis of the chord stored in the applied chord storage portion and the musical performance data input by the musical performance data input portion.

3. The electronic musical instrument according to claim 1, wherein the chord detection timing is set with respect to bar timing or beat timing.

4. The electronic musical instrument according to claim 1, wherein the time limit is set with respect to bar timing or beat timing.

5. The electronic musical instrument according to claim 1, wherein the musical performance data input portion is a keyboard.

6. The electronic musical instrument according to claim 1, wherein the chord application instruction portion is a pedal.

7. The electronic musical instrument according to claim 1, wherein the chord application portion generates automatic accompaniment notes on the basis of the applied chord.

8. The electronic musical instrument according to claim 1, wherein the chord application portion generates harmony notes on the basis of the applied chord.

9. The electronic musical instrument according to claim 1, wherein the chord detection portion detects a chord on the basis of performance data input during time range before and after a chord detection reference position.

10. The electronic musical instrument according to claim 1, wherein the chord application portion applies the first chord detected after start of a musical piece regardless of the instruction of chord application by the chord application instruction portion.

11. The electronic musical instrument according to claim 1, wherein the chord detection timing setting portion and the time limit setting portion set the chord detection timing and the time limit respectively by using a display.

12. The electronic musical instrument according to claim 1, wherein the chord detection timing setting portion and the time limit setting portion set the chord detection timing and the time limit respectively by using operating elements.

13. The electronic musical instrument according to claim 1, wherein the chord detection timing setting portion and the time limit setting portion set the chord detection timing and the time limit respectively in accordance with tempo of a musical piece or accompaniment style to be used.

* * * * *